United States Patent [19]

Rabe

[11] 4,005,337

[45] Jan. 25, 1977

[54] CONSTANT ENERGY STROBE SOURCE

[75] Inventor: Blaine R. Rabe, Urbana, Ohio

[73] Assignee: Grimes Manufacturing Company, Urbana, Ohio

[22] Filed: July 21, 1975

[21] Appl. No.: 597,893

[52] U.S. Cl. ..... 315/241 S; 315/224; 315/225; 315/241 R; 320/1

[51] Int. Cl.[2] ..... H05B 41/32; H05B 41/29

[58] Field of Search ..... 315/209 R, 209 CD, 224, 315/225, 241 P, 241 R, 241 S; 320/1; 331/112; 354/145

[56] References Cited

UNITED STATES PATENTS

| | | | |
|---|---|---|---|
| 3,421,069 | 1/1969 | Minks | 331/112 X |
| 3,541,420 | 11/1970 | Rees | 320/1 |
| 3,688,659 | 9/1972 | Takishima et al. | 315/241 P X |

*Primary Examiner*—Eugene La Roche
*Attorney, Agent, or Firm*—Biebel, French & Nauman

[57] ABSTRACT

In a strobe lamp system, a circuit for monitoring the amount of energy supplied to a capacitor storage bank from a power supply senses the magnitude of the current flowing to the capacitor storage bank and produces an integral function indicating the charge stored on the capacitor bank. This integral function and the voltage across the capacitor bank are monitored by a comparator. When a selected amount of energy has been stored, a switching circuit is activated by the comparator to disconnect the capacitor storage bank from the power supply.

9 Claims, 3 Drawing Figures

CONSTANT ENERGY STROBE SOURCE

BACKGROUND OF THE INVENTION

This invention relates to an apparatus for storing a predetermined amount of electrical energy in a capacitor bank to be supplied to a strobe lamp. Strobe lamps typically comprise a glass bulb in which there are are two power electrodes, a triger electrode, and a gas which when ionized generates light of high intensity. A high electrical potential is placed across the two power electrodes, and when firing of the lamp is desired, a firing pulse will be applied to the trigger electrode. This firing pulse will ionize the gas sufficiently to allow current to flow between the two power electrodes with the result that the strobe lamp is flashed. Energy for this type of lamp generally is stored in a bank of capacitors placed in parallel with the lamp.

The capacitor bank will undergo significant changes in capacitance both as a result of aging and as a result of variations in ambient temperature. These capacitance changes are particularly troublesome in aircraft strobe lamp systems where variations in ambient temperature are likely to be pronounced. If no compensation is made for such capacitance variations, the capacitor bank will at times store and supply an excessive amount of energy to the strobe lamp and thus decrease the life span of the lamp. Strobe lamp intensity will also vary noticeably and this may be objectionable.

In the past, the energy stored in the capacitor bank has been approximated as a function only of the voltage across the capacitor bank; this voltage was monitored and compared against a predetermined voltage level in order to determine when the desired amount of energy was stored. A device using this technique is shown in U.S. Pat. No. 3,868,562, issued Feb. 25, 1975. Such an approach is acceptable only where the capacitance of the storage bank does not vary.

SUMMARY OF THE INVENTION

This invention relates to an improved circuit for supplying uniform amounts of energy to a capacitor storage means used to supply energy to strobe lamps.

There is provided a control means, connected between the power source and the capacitor means, for monitoring the amount of energy applied to the capacitor means and for disconnecting the power source from the capacitor means when the amount of energy applied to said capacitor means equals a desired amount of energy.

The control means comprises a sensor means for sensing the current applied to the capacitor means and for supplying an output proportional thereto and integrator means for integrating the output of the sensor means to provide an output indicative of the charge stored by the capacitor means. The control means further comprises a comparator means for supplying a switching signal in response to the output of the integrator means and a signal proporational to the voltage across the capacitor storage means. A switching means is provided in the control means for disconnecting the capacitor means from the means for charging in response to the switching signal. This switching means may comprise a semiconductor device, such as a silicon controlled rectifier. The integrator means may further comprise a reset means for resetting the integrator means to an initial condition.

Accordingly it is an object of this invention to provide an improved constant energy strobe source which supplies an equal amount of energy to a capacitor storage bank in preparation for each strobe lamp discharge.

It is also an object of this invention to sense the amount of energy applied to a storage device by monitoring the current applied to the device and then integrated this over a period of time.

Further, it is an object of this invention to compare a signal indicative of the integral of the current applied to an energy storage device with a signal proportional to the voltage of the storage device and for preventing further application of energy to the storage device when an equality is reached.

These and other objects and advantages of the invention will be apparent from the following description, the accompanying drawings, and the appended claims.

DESCRIPTION OF THE PREFERRED EMBODIMENT

Figure 1:
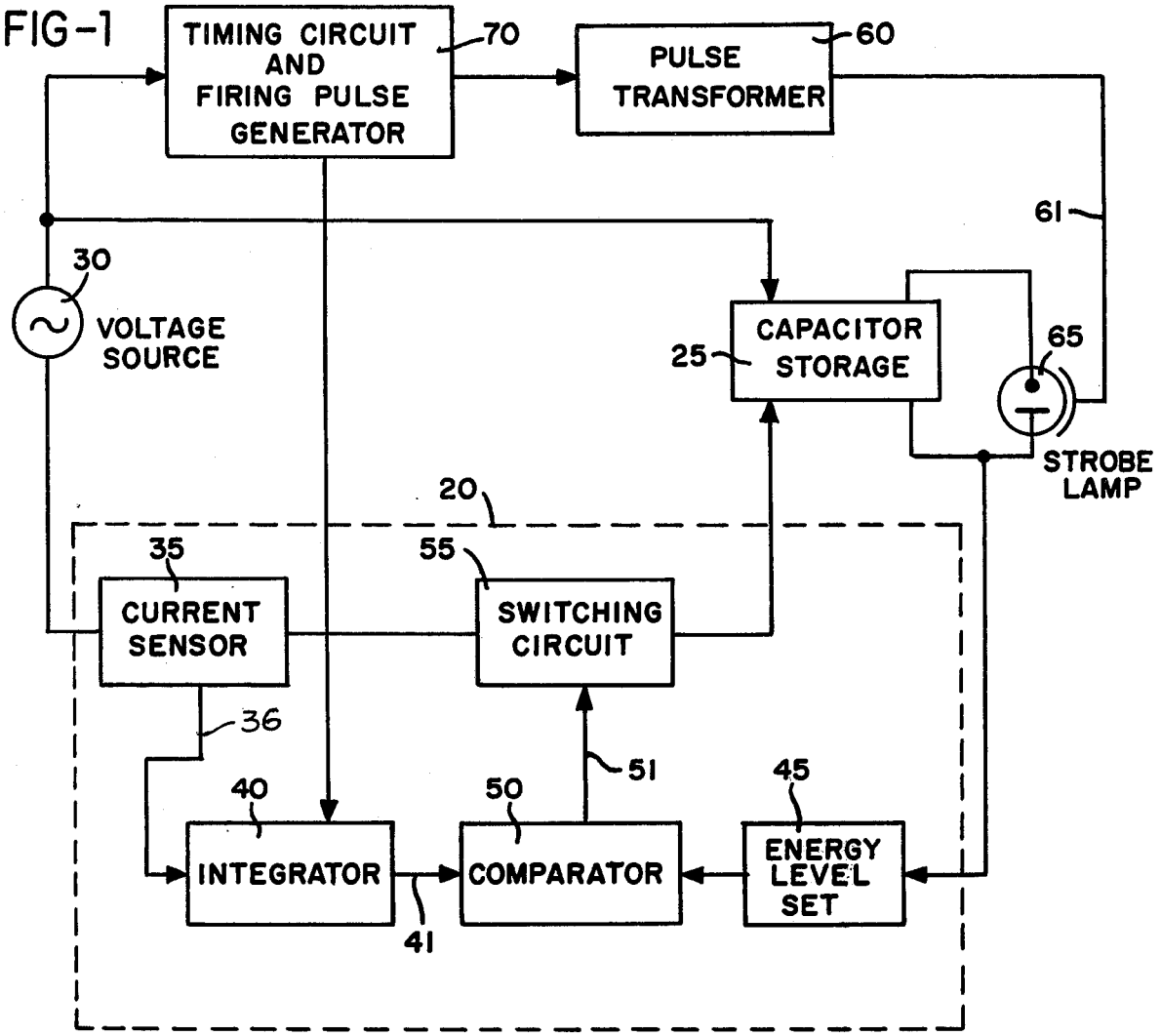
FIG. 1 is a block diagram representation of the circuit of the instant invention.

Reference is now made to the drawings which illustrate the preferred embodiment of the invention, and particularly to FIG. 1 which is a block diagram showing the control circuit 20 used to regulate the energy stored in a capacitor storage bank 25. A voltage source 30 is the means for supplying power to the system. Current sensor means 35 senses the amount of current supplied to the capacitor storage 25 and provides an output on line 36 which is proportional to this current. Integrator 40 integrates the output from the current sensor 35 with respect to time and supplies a signal on line 41 which is a function of this integral.

An energy level setting means or circuit 45 provides an adjustable voltage level to comparator 50 which is proportional to the voltage across capacitor storage 25. Comparator 50 provides a signal on line 51 when the desired quantity of energy has been supplied to the capacitor storage 25 such that the charging of the capacitor storage bank is thereafter inhibited by switching circuit 55. A trigger pulse may then be supplied by pulse transformer 60 on line 61 to strobe lamp 65 when an output is received from the timing circuit and firing pulse generator 70. The trigger pulse causes the strobe lamp 65 to fire and the capacitor storage 25 thus discharges its predetermined quantity of energy through the strobe lamp 65. The output of firing pulse generator 70 is also supplied to integrator 40 to reset integrator 40 to an initial value. The circuit of FIG. 1 is then ready to monitor the next application of energy to capacitor storage 25.

Figure 2:
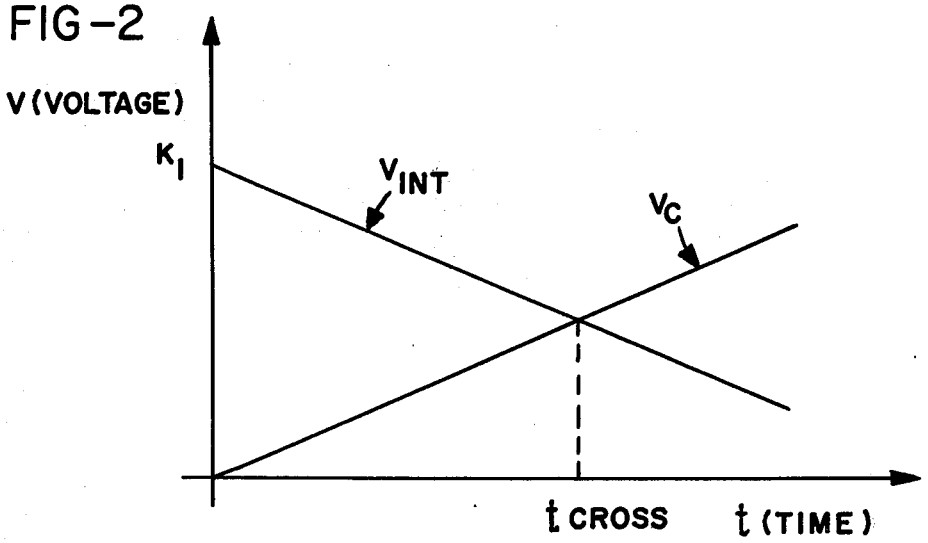
FIG. 2 is a graph which is useful in explaining the present invention.

The theory of operation of the circuit shown in FIG. 1 can be explained by reference to FIG. 2 in which two voltages functions are depicted. $V_{INT}$ is the voltage at the output of integrator 40 (FIG. 1) and $V_C$ is the voltage at the output of the energy level set 45 (FIG. 1). At time $t_{cross}$ these two voltages are equal. The voltage $V_{INT}$ represents the negative of the integral of the charging current, integrating down from the constant, $K_1$. The voltage $V_c$ is proportional to the voltage across the capacitor bank, $V_{cap}$.

Therefore $$V_{INT} = K_1 - (K_2/C) \int idt$$

where $i$ is the charging current.

$$V_{INT} = K_1 - (K_2Q/C),$$

where $Q =$ charge on the capacitor bank.

Also;

$$V_C = K_3V_{cap} = (K_3/C) \int idt = (K_3Q/C)$$

At time $t = t_{cross}$, $$V_c = V_{INT}$$

$$(K_3Q/C) = K_1 - (K_2Q/C)$$

Multiplying both sides by $Q$, $$2(K_3 + K_2)\ ½\ (Q^2/C) = K_1Q$$

Since the energy stored by a capacitor is $$E = ½\ (Q^2/C),$$

$$E = K_1Q/[2\ (K_3 + K_2)]$$

Thus, if the charging current remains reasonably constant, the energy stored will be specified.

Figure 3:
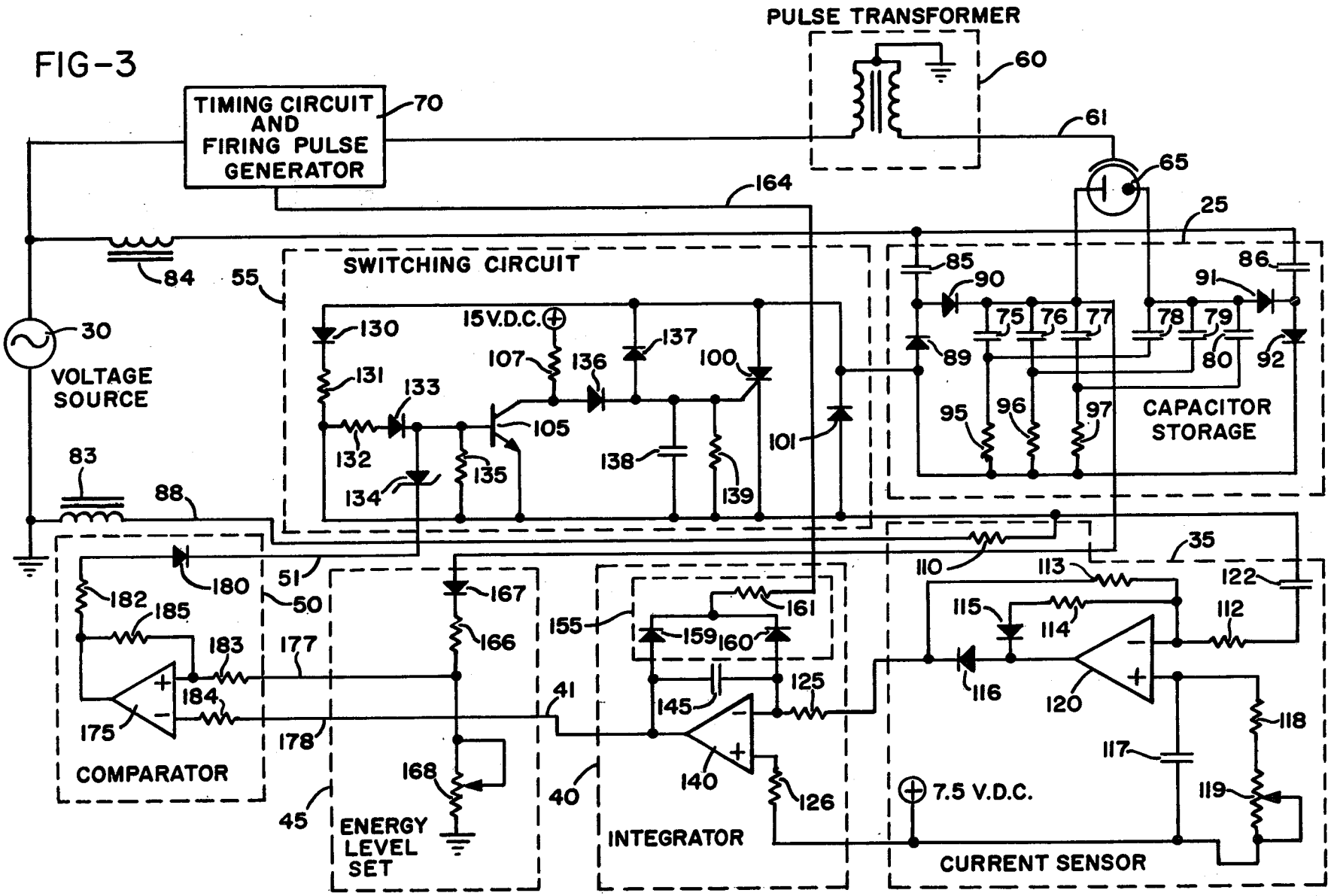
FIG. 3 is a detailed schematic drawing of the circuit of the instant invention.

Reference is now made to FIG. 3 which shows the preferred embodiment of the invention in greater detail and in which the reference numerals of FIG. 1 are used to designate corresponding structure. Capacitor storage circuit 25 comprises capacitors 75 through 80. These capacitors are charged by voltage source 30 through inductors 83 and 84 which are placed in the circuit to limit the initial charging current supplied to the capacitors and to maintain the charging current at a reasonably constant level. The charging of capacitors 75 through 80 is accomplished by the use of voltage multiplier capacitors 85 and 86. The capacitor storage circuit 25 operates in the following manner. With reference to the capacitors 75 and 77, assume that a positive potential is initially presented on line 88. Diode 89 is forward biased and capacitor 85 charges. On the next half cycle, diode 90 will be forward biased, and capacitor 85 will be in series with voltage source 30, thus putting a greater potential across the parallel combination of capacitors 75 through 77 than is supplied by voltage source 30. After a number of charging cycles, capacitor 85 will charge to the peak potential of voltage source 30. Thus capacitors 75, 76, and 77 will reach a steady state voltage of twice the peak voltage potential presented by the voltage source 30. Similarly, capacitors 78, 79 and 80 are charged through voltage multiplier capacitor 86 and diodes 91 and 92 to twice the peak voltage potential of voltage source 30. It can be seen that capacitors 75 through 77 are in series with capacitors 78 through 80, so that the strobe lamp 65 is presented with a charge of four times that of the peak voltage of voltage source 30.

Charging of the capacitor storage circuit 25 is accomplished via switching circuit 55 which includes SCR 100 and diode 101. Assuming there is no positive potential on line 51, the gate electrode of SCR 100 is held at a positive potential and SCR 100 is thus switched on. When a positive potential appears on line 51, however, transistor 105 is switched on and the gate current of SCR 100 is thus reduced to zero. As the voltage across SCR 100 drops to zero and below, the anode of SCR 100 is starved of anode current. The combination of no anode current and no gate current will switch SCR 100 off. When SCR 100 is switched off, capacitors 85 and 86 are not able to charge and discharge but are only able to charge. Therefore, capacitors 85 and 86 cannot pass current. This effectively opens the charging path to capacitors 75 through 80 from voltage source 30. SCR 100 will not again conduct until gate drive is reapplied and this will not occur until transistor 105 is switched off. Transistor 105, in turn, will not switch on until the potential applied on line 51 is terminated.

Even after the termination of the positive potential on line 51, however, the gate drive to SCR 100 will not be reapplied until a zero potential exists across SCR 100. SCR 100 is protected from damage which could result from turning SCR 100 on with a large potential across the semiconductor as follows. When SCR 100 is on, of course, no signal will be applied to the base of transistor 105. When, however, SCR 100 has been switched off, an alternating potential will exist across the SCR. A base current will then be applied to transistor 105 sufficient to switch the transistor on and thus effectively remove any gate current from SCR 100. When the potential across SCR 100 drops to near zero, no base current is applied to the transistor 105 and the transistor 105 switches off. Therefore, if there is no positive potential on line 51 so that transistor 105 has switched off and, further, if there is a near zero potential across SCR 100, then gate current will be applied to SCR 100 through resistor 107 and the SCR will then begin to conduct as the voltage across it increases.

The current sensor circuit 35 includes resistor 110. The sensor circuit 35 also includes operational amplifier 120 connected as a rectifier. As can be seen from FIG. 3 of the drawings, all current applied to capacitor storage 25 passes through resistor 110 and the potential across this resistor is thus an indication of the current being applied to the capacitor storage 25. This potential is amplified and rectified by sensor circuit 35.

If this potential were not rectified, integrator 40 would subtract the current sensor output provided on the negative half cycle of voltage source 30 from the output provided on the positive half cycle. Because of the configuration of capacitor storage 25, energy is applied to capacitor storage 25 on both the positive and the negative half cycles and therefore rectification is required in order that an accurate integral be obtained.

The output of the current sensor circuit 35 is supplied to integrator 40 which is comprised of operational amplifier 140 with a capacitor feedback, capacitor 145. The integrator 40 is reset by means of reset circuit 155, including diodes 159 and 160, which shorts capacitor 145 when a low signal is applied to line 164. Thus the potential across the capacitor 145 may be effectively altered to the prescribed initial state for the integrator.

The output of integrator 40 is a function of the integral of current supplied to capacitor storage 25 and is applied to comparator 50 which includes an operational amplifier 175 with resistive feedback. The comparator 50 also receives a signal on line 177 from energy level set 45. The signal on line 177 is directly proportional to the voltage potential stored by the capacitor bank 25. The output of the operational amplifier 175 will go positive only when the voltage applied to its positive input 177 is greater than the voltage applied to its negative input 178. This will occur only when the negative going integral of the current from integrator 40 is exceeded by the positive going potential supplied by the energy level set 45. When the output of operational amplifier 175 does go positive, indicating that a sufficient amount of energy is stored, diode 180 will be forward biased and will apply a positive potential to line 51. This positive potential will act, as described above, to actuate switching circuit 55.

Exemplary values for the circuit components shown in FIG. 3 are as follows.

| | |
|---|---|
| 85, 86 | 4μfd.; 115 VAC |
| 89, 90, 91, 92, 101 | 1N3613 |
| 95, 96, 97 | 1Ω ± 5%; 3 watt |
| 100 | 2N2329 |
| 137, 130, 167 | 1N649 |
| 133, 136, 180, 159, 160, 115, 116 | 1N4148 |
| 105 | 2N2222A |
| 107, 182 | 10K Ω ± 5%; 1/4 watt |
| 139 | 1K Ω ± 5%; 1/4 watt |
| 138 | 47 pFd. |
| 131 | 47 K Ω ± 5%; 1/2 watt |
| 132 | 2.7K Ω ± 5%; 1/4 watt |
| 135 | 4.7K Ω ± 5%; 1/4 watt |
| 134 | 1N754A |
| 110 | .1 Ω ± 5%; 2 watt |
| 113, 114, 112, 118, 183, 184 | 100K Ω ± 1%; 1/10 watt |
| 119 | 500K Ω potentiometer |
| 117 | 470 pFd. |
| 126 | 1M Ω ±; 1/10 watt |
| 125 | 700K Ω ± 1%; 1/10 watt |
| 161 | 47K Ω ± 5%; 1/4 watt |
| 145 | .033 mfd. |
| 166 | 464K Ω ± 1%; 1/4 watt |
| 168 | 50K Ω potentiometer |
| 185 | 1M Ω ± 5%; 1/4 watt |
| 122 | .1 mFd. |
| 120, 140, 175 | Operational amplifiers, such as MC741, available from Motorola Semiconductor Products, Inc., Phoenix, Arizona |

While the form of apparatus herein described constitutes a preferred embodiment of the invention, it is to be understood that the invention is not limited to this precise form of apparatus and that changes may be made therein without departing from the scope of the invention which is defined in the appended claims.

What is claimed is:

1. In a lighting system in which a capacitor means for storing energy is successively charged by a power source and then discharged through a strobe lamp, the improvement comprising:

control means, connected between said power source and said capacitor means, for monitoring the amount of energy applied to said capacitor means for disconnecting said power source from said capacitor means when the amount of energy applied to said capacitor means equal a predetermined constant amount of energy, said control means comprising:

sensor means for sensing the current applied to said capacitor means and for supplying an output proportional thereto, and, integrator means for integrating the output of said sensor means.

2. The system of claim 1 further comprising pulse means for supplying a pulse to said strobe lamp to cause said capacitor means to discharge through said strobe lamp and for supplying a pulse to said integrator means to reset said integrator means to an initial output condition.

3. The system of claim 1 wherein said control means further comprises:

energy level setting means for supplying an output proportional to the voltage differential across said capacitor means, and comparator means for supplying a switching signal when the output of said integrator means equals the output of energy level setting means.

4. The system of claim 3 wherein said control means further comprises switching means, responsive to said switching signal, for disconnecting said capacitor means from said means for charging.

5. The system of claim 4 wherein said switching means is a silicon controlled rectifier.

6. A lighting control system for supplying a desired quantity of energy to an energy device prepartory to supplying said desired quantity of energy to a strobe lamp comprising:

means for supplying power;

current sensor means for sensing the current output of said means for supplying power and providing an output proportional to said current output;

energy storage means for storing energy supplied by said means for supplying power;

energy level setting means for providing an output proportional to the voltage level of said energy storage means;

integrator means for integrating the output of said current sensor means to provide an output indicative of the total current applied to said energy storage means;

comparator means, responsive to the output of said energy level setting means and to the output of said integrator means, for providing an output when the outputs from said energy level setting means and said integrator means are equal, the output from the comparator means indicating that the desired quantity of energy has been supplied to said energy storage means;

switching means, connected between said means for supplying power and said energy storage means, and responsive to the output of said comparator means, for preventing further energy storage by said energy storage means when the quantity of energy stored is equal to that desired to be stored; and strobe lamp means, connected to said energy storage means, for flashing after said desired quantity of energy is stored by said energy storage means.

7. The system of claim 6 wherein said energy storage means comprises a capacitor.

8. The system of claim 6 wherein said integrator means further comprises reset means for resetting said integrator means to an initial condition.

9. The system of claim 8 wherein said energy storage means is periodically discharged through said strobe lamp means upon application of a firing pulse to said strobe lamp and wherein said integrator means is reset by said reset means at the time of said discharge.

* * * * *